US010266955B2

(12) United States Patent
Dyballa et al.

(10) Patent No.: US 10,266,955 B2
(45) Date of Patent: Apr. 23, 2019

(54) ELECTROCHEMICAL COUPLING OF ANILINES

(71) Applicants: Katrin Marie Dyballa, Recklinghausen (DE); Robert Franke, Marl (DE); Dirk Fridag, Haltern am See (DE); Siegfried R. Waldvogel, Gau-Algesheim (DE); Bernd Elsler, Bonn (DE)

(72) Inventors: Katrin Marie Dyballa, Recklinghausen (DE); Robert Franke, Marl (DE); Dirk Fridag, Haltern am See (DE); Siegfried R. Waldvogel, Gau-Algesheim (DE); Bernd Elsler, Bonn (DE)

(73) Assignee: Evonik Degussa GmbH, Essen (DE)

( * ) Notice: Subject to any disclaimer, the term of this patent is extended or adjusted under 35 U.S.C. 154(b) by 466 days.

(21) Appl. No.: 14/773,224

(22) PCT Filed: Feb. 26, 2014

(86) PCT No.: PCT/EP2014/053676
§ 371 (c)(1),
(2) Date: Sep. 4, 2015

(87) PCT Pub. No.: WO2014/135405
PCT Pub. Date: Sep. 12, 2014

(65) Prior Publication Data

US 2016/0010226 A1 Jan. 14, 2016

(30) Foreign Application Priority Data

Mar. 7, 2013 (DE) ..... 10 2013 203 867

(51) Int. Cl.
*C25B 3/00* (2006.01)
*C25B 3/10* (2006.01)
*C25B 15/02* (2006.01)
*C25B 9/08* (2006.01)

(52) U.S. Cl.
CPC ..... *C25B 3/10* (2013.01); *C25B 9/08* (2013.01); *C25B 15/02* (2013.01)

(58) Field of Classification Search
CPC ..... C25B 3/02; C25B 3/10; C25B 3/00
USPC ..... 205/414, 415, 416, 418, 419
See application file for complete search history.

(56) References Cited

U.S. PATENT DOCUMENTS

2012/0080320 A1* 4/2012 Fischer ..... C25B 3/10 205/418

FOREIGN PATENT DOCUMENTS

| | | | |
|---|---|---|---|
| JP | 61-225214 | A | 10/1986 |
| JP | 2-54129 | A | 3/1990 |
| JP | 2012-528938 | A | 11/2012 |
| WO | WO 2014/135371 | A1 | 9/2014 |

OTHER PUBLICATIONS

Wawzonek et al., "Electrolytic Oxidation of Aromatic Anilines," J. Electrochem. Soc.: Electrochemical Science (Oct. 1967), vol. 114, No. 10, pp. 1025-1029. (Year: 1967).*
Domagala et al., "Cross-Coupling Processes in Chemical and Electrochemical Oxidation of the Aniline Derivatives and 4-Aminophenol Mixtures," The 4th International Symposium Electrochemistry in Practice and Theory (Sep. 11-13, 1996), pp. 177-187. (Year: 1996).*
Penketh, "The Oxidation Potentials of Phenolic and Amino Antioxidants," J. Appl. Chem. (Sep. 1957), vol. 7, pp. 512-521. (Year: 1957).*
Conant et al., "The Irreversible Oxidation of Organic Compounds I. The Oxidation of Aminophenols by Reagents of Definite Potential," Journal of the American Chemical Society (Dec. 1926), vol. 48, pp. 3178-3192. (Year: 1926).*
Bacon J et al., "Anodic Oxidations of Aromatic Amines. III. Substituted Anilines in Aqueous Media", Journal of the American Chemical Society, vol. 90, No. 24, Nov. 20, 1968, pp. 6596-6599.
Domagala S. et al., "Cross-coupling processes in chemical and electrochemical oxidation of the aniline derivatives and 4-aminophenol mixtures". The 4th International Symposium Electrochemistry in Practice and Theory, Sep. 11-13, 1996, 12 pages.
Kirste et al., "Efficient Anodic and Direct Phenol-Arene C,C Cross-Coupling: The Benign Role of Water or Methanol", Journal of the American Chemical Society, vol. 134. No. 7, Feb. 22, 2012, pp. 3571-3576.
International Search Report dated May 8, 2014 for PCT/EP2014/053676 filed on Feb. 26, 2014.
Office Action dated Mar. 6, 2017 in Japanese Patent Application No. 2015-560614 (submitting English language translation only).
U.S. Appl. No. 14/772,874, filed Sep. 4, 2015, Dyballa, et al.
U.S. Appl. No. 14/773,228, filed Sep. 4, 2015, Dyballa, et al.
U.S. Appl. No. 14/773,102, filed Sep. 4, 2015, Dyballa, et al.
Rodney L. Hand, et al., "Anodic Oxidation Pathways of N-Alkylanilines", Contribution from the Departments of Chemistry, Journal of the American Chemical Society, 96:3, XP 55306556A, Feb. 6, 1974, pp. 850-860.
Written Opinion dated May 8, 2014 in PCT/EP2014/053676.

* cited by examiner

*Primary Examiner* — Edna Wong
(74) *Attorney, Agent, or Firm* — Oblon, McClelland, Maier & Neustadt, L.L.P.

(57) ABSTRACT

An electrochemical method for coupling anilines. When coupling two different anilines, the difference of the oxidation potential of the substrates is in the region of between 10 mV to 450 mV, and the aniline with the highest oxidation potential is added in excess. The method allows biaryldiamines to be electrochemically produced, and can avoid the need for multi-step syntheses using metallic reagents.

5 Claims, 2 Drawing Sheets

ELECTROCHEMICAL COUPLING OF ANILINES

The present invention relates to an electrochemical process for coupling of anilines to give biaryldiamines.

The term "anilines" is used in this application as a generic term and thus encompasses substituted anilines. It is possible here to couple two identical or two different anilines to one another.

Methods used to date for preparation of biaryldiamines utilize the indirect route of a sigmatropic rearrangement of diarylhydrazines (see: S.-E. Suh, I.-K. Park, B.-Y. Lim, C.-G. Cho, *Eur. J. Org. Chem.* 2011, 3, 455, H.-Y. Kim, W.-J. Lee, H.-M. Kang, C.-G. Cho, *Org. Lett.* 2007, 16, 3185, H.-M. Kang, Y.-K. Lim, I.-J. Shin, H.-Y. Kim, C.-G. Cho, *Org. Lett.* 2006, 10, 2047, Y.-K. Lim, J.-W. Jung, H. Lee, C.-G. Cho, *J. Org. Chem.* 2004, 17, 5778), in order to obtain biaryl systems, since direct oxidative cross-coupling of aniline derivatives with inorganic oxidizing agents such as Cu(II) gives poor yields and has only been described for naphthylamines (see: M. Smrcina, S. Vyskocil, B. Maca, M. Polasek, T. A. Claxton, A. P. Abbott, P. Kocovsky, *J. Org. Chem.* 1994, 59, 2156).

Benzidine/semidine rearrangements are usually not very selective and give many carcinogenic by-products. The hydrazines are often synthesized with the aid of transition metal catalysts, which constitutes an additional cost factor.

A great disadvantage of the abovementioned methods for aniline-aniline cross-coupling is the frequent necessity for dry solvents and exclusion of air. In addition, large amounts of oxidizing agents, some of them toxic, are sometimes used. During the reaction, toxic by-products often occur, which have to be separated from the desired product in a costly and inconvenient manner and disposed of at great cost. As a result of increasingly scarce raw materials and the rising relevance of environmental protection, the cost of such transformations is rising. Particularly in the case of utilization of multistage sequences, an exchange between various solvents is necessary. Moreover, very toxic intermediates occur here.

By electrochemical treatment, biaryldiamines are prepared, without needing to add organic oxidizing agents, to work with exclusion of moisture or to observe anaerobic reaction regimes.

This direct method of C—C coupling opens up an inexpensive and environmentally friendly alternative to existing multistage synthesis routes conventional in organic synthesis.

The problem addressed by the present invention was that of providing an electrochemical process in which anilines can be coupled to one another, and multistage syntheses using metallic reagents can be dispensed with. In addition, access to new products is to be enabled in this way.

The problem is solved by a process according to embodiments of the present invention.

Figure 1:
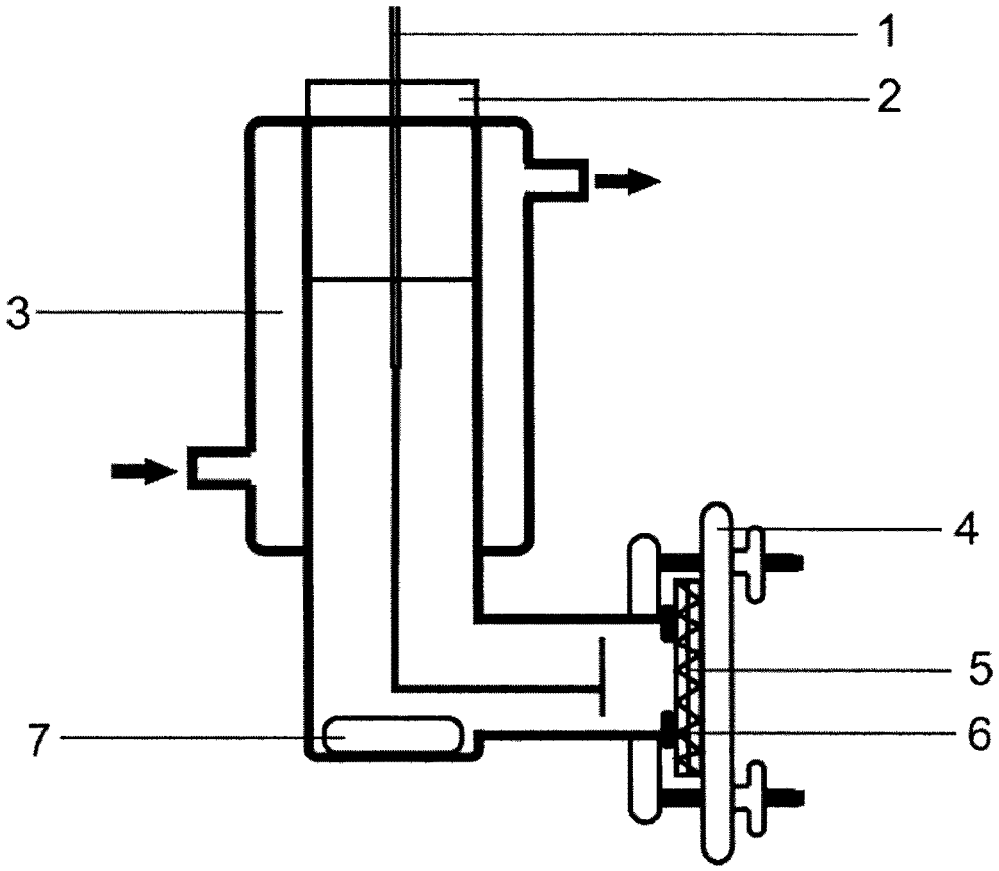
FIG. 1 shows a reaction apparatus for performing a coupling reaction according to one or more embodiments of the invention.

Compounds of one of the general formulae (I) to (IV) can be prepared by the process described:

(I)

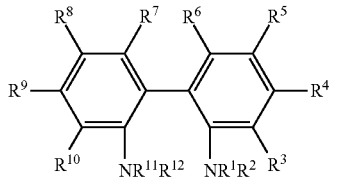

(I')

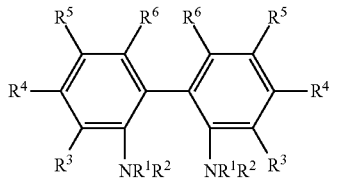

(II)

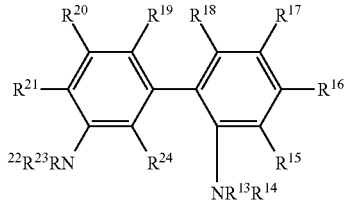

(II')

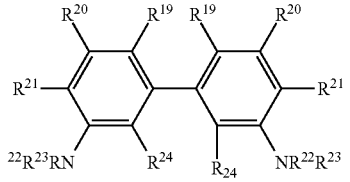

(III)

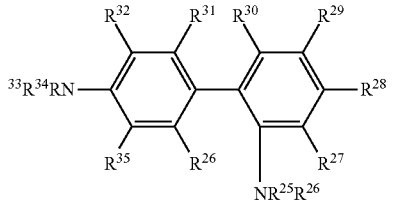

(IV)

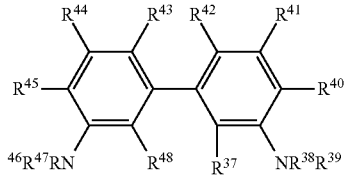

where the substituents $R^1$ to $R^{48}$ are each independently selected from the group of hydrogen, hydroxyl, $(C_1-C_{12})$-alkyl, $(C_1-C_{12})$-heteroalkyl, $(C_4-C_{14})$-aryl, $(C_4-C_{14})$-aryl-$(C_1-C_{12})$-alkyl, $(C_4-C_{14})$-aryl-O—$(C_1-C_{12})$-alkyl, $(C_3-C_{14})$-heteroaryl, $(C_3-C_{14})$-heteroaryl-$(C_1-C_{12})$-alkyl, $(C_3-C_{12})$-cycloalkyl, $(C_3-C_{12})$-cycloalkyl-$(C_1-C_{12})$-alkyl, $(C_3-C_{12})$-heterocycloalkyl, $(C_3-C_{12})$-heterocycloalkyl-$(C_1-C_{12})$-alkyl, O—$(C_1-C_{12})$-alkyl, O—$(C_1-C_{12})$-heteroalkyl, O—$(C_4-C_{14})$-aryl, O—$(C_4-C_{14})$-aryl-$(C_1-C_{14})$-alkyl, O—$(C_3-C_{14})$-heteroaryl, O—$(C_3-C_{14})$-heteroaryl-$(C_1-C_{14})$-alkyl, O—$(C_3-C_{12})$-cycloalkyl, O—$(C_3-C_{12})$-cycloalkyl-$(C_1-C_{12})$-alkyl, O—$(C_3-C_{12})$-heterocycloalkyl, O—$(C_3-C_{12})$-heterocycloalkyl-$(C_1-C_{12})$-alkyl, halogens, S—$(C_1-C_{12})$-alkyl, S—$(C_1-C_{12})$-heteroalkyl, S—$(C_4-C_{14})$-aryl, S—$(C_4-C_{14})$-aryl-$(C_1-C_{14})$-alkyl, S—$(C_3-C_{14})$-heteroaryl, S—$(C_3-C_{14})$-heteroaryl-$(C_1-C_{14})$-alkyl, S—$(C_3-C_{12})$-cycloalkyl, S—$(C_3-C_{12})$-cycloalkyl-$(C_1-C_{12})$-alkyl, S—$(C_3-$ $C_{12}$)-heterocycloalkyl, ($C_1$-$C_{12}$)-acyl, ($C_4$-$C_{14}$)-aroyl, ($C_4$-$C_{14}$)-aroyl-($C_1$-$C_{14}$)-alkyl, ($C_3$-$C_{14}$)-heteroaroyl, ($C_1$-$C_{14}$)-dialkylphosphoryl, ($C_4$-$C_{14}$)-diarylphosphoryl, ($C_3$-$C_{12}$)-alkylsulphonyl, ($C_3$-$C_{12}$)-cycloalkylsulphonyl, ($C_4$-$C_{12}$)-arylsulphonyl, ($C_1$-$C_{12}$)-alkyl-($C_4$-$C_{12}$)-arylsulphonyl, ($C_3$-$C_{12}$)-heteroarylsulphonyl, (C═O)O—($C_1$-$C_{12}$)-alkyl, (C═O)O—($C_1$-$C_{12}$)-heteroalkyl, (C═O)O—($C_4$-$C_{14}$)-aryl, where the alkyl, heteroalkyl, cycloalkyl, heterocycloalkyl, aryl and heteroaryl groups mentioned are optionally mono- or polysubstituted.

Alkyl represents an unbranched or branched aliphatic radical.

Aryl for aromatic (hydrocarbyl) radicals, preferably having up to 14 carbon atoms, for example phenyl ($C_6H_5$—), naphthyl ($C_{10}H_7$—), anthryl ($C_{14}H_9$—), preferably phenyl.

Cycloalkyl for saturated cyclic hydrocarbons containing exclusively carbon atoms in the ring.

Heteroalkyl for an unbranched or branched aliphatic radical which may contain one to four, preferably one or two, heteroatom(s) selected from the group consisting of N, O, S and substituted N.

Heteroaryl for an aryl radical in which one to four, preferably one or two, carbon atom(s) may be replaced by heteroatoms selected from the group consisting of N, O, S and substituted N, where the heteroaryl radical may also be part of a larger fused ring structure.

Heterocycloalkyl for saturated cyclic hydrocarbons which may contain one to four, preferably one or two, heteroatom(s) selected from the group consisting of N, O, S and substituted N.

A heteroaryl radical which may be part of a fused ring structure is preferably understood to mean systems in which fused five- or six-membered rings are formed, for example benzofuran, isobenzofuran, indole, isoindole, benzothiophene, benzo(c)thiophene, benzimidazole, purine, indazole, benzoxazole, quinoline, isoquinoline, quinoxaline, quinazoline, cinnoline, acridine.

The substituted N mentioned may be monosubstituted, and the alkyl, heteroalkyl, cycloalkyl, heterocycloalkyl, aryl and heteroaryl groups may be mono- or polysubstituted, more preferably mono-, di- or trisubstituted, by radicals selected from the group consisting of hydrogen, ($C_1$-$C_{14}$)-alkyl, ($C_1$-$C_{14}$)-heteroalkyl, ($C_4$-$C_{14}$)-aryl, ($C_4$-$C_{14}$)-aryl-($C_1$-$C_{14}$)-alkyl, ($C_3$-$C_{14}$)-heteroaryl, ($C_3$-$C_{14}$)-heteroaryl-($C_1$-$C_{14}$)-alkyl, ($C_3$-$C_{12}$)-cycloalkyl, ($C_3$-$C_{12}$)-cycloalkyl-($C_1$-$C_{14}$)-alkyl, ($C_3$-$C_{12}$)-heterocycloalkyl, ($C_3$-$C_{12}$)-heterocycloalkyl-($C_1$-$C_{14}$)-alkyl, $CF_3$, halogen (fluorine, chlorine, bromine, iodine), ($C_1$-$C_{10}$)-haloalkyl, hydroxyl, ($C_1$-$C_{14}$)-alkoxy, ($C_4$-$C_{14}$)-aryloxy, O—($C_1$-$C_{14}$)-alkyl-($C_4$-$C_{14}$)-aryl, ($C_3$-$C_{14}$)-heteroaryloxy, N(($C_1$-$C_{14}$)-alkyl)$_2$, N(($C_4$-$C_{14}$)-aryl)$_2$, N(($C_1$-$C_{14}$)-alkyl)(($C_4$-$C_{14}$)-aryl), where alkyl, aryl, cycloalkyl, heteroalkyl, heteroaryl and heterocycloalkyl are each as defined above.

In one embodiment, $R^1$, $R^2$, $R^{11}$, $R^{12}$, $R^{13}$, $R^{14}$, $R^{22}$, $R^{23}$, $R^{25}$, $R^{26}$, $R^{33}$, $R^{34}$, $R^{38}$, $R^{39}$, $R^{46}$, $R^{47}$ are selected from —H and/or a protecting group for amino functions described in "Greene's Protective Groups in Organic Synthesis" by P. G. M. Wuts and T. W. Greene, 4th edition, Wiley Interscience, 2007, p. 696-926.

In one embodiment, $R^3$, $R^4$, $R^5$, $R^6$, $R^7$, $R^8$, $R^9$, $R^{10}$, $R^{15}$, $R^{16}$, $R^{17}$, $R^{18}$, $R^{19}$, $R^{20}$, $R^{21}$, $R^{24}$, $R^{27}$, $R^{28}$, $R^{29}$, $R^{30}$, $R^{31}$, $R^{32}$, $R^{35}$, $R^{36}$, $R^{37}$, $R^{40}$, $R^{41}$, $R^{42}$, $R^{43}$, $R^{44}$, $R^{45}$, $R^{48}$ are selected from the group of hydrogen, hydroxyl, ($C_1$-$C_{12}$)-alkyl, ($C_1$-$C_{12}$)-heteroalkyl, ($C_4$-$C_{14}$)-aryl, ($C_4$-$C_{14}$)-aryl-($C_1$-$C_{12}$)-alkyl, O—($C_1$-$C_{12}$)-alkyl, O—($C_1$-$C_{12}$)-heteroalkyl, O—($C_4$-$C_{14}$)-aryl, O—($C_4$-$C_{14}$)-aryl-($C_1$-$C_{14}$)-alkyl, O—($C_3$-$C_{14}$)-heteroaryl, O—($C_3$-$C_{14}$)-heteroaryl-($C_1$-$C_{14}$)-alkyl, O—($C_3$-$C_{12}$)-cycloalkyl, O—($C_3$-$C_{12}$)-cycloalkyl-($C_1$-$C_{12}$)-alkyl, O—($C_3$-$C_{12}$)-heterocycloalkyl, O—($C_3$-$C_{12}$)-heterocycloalkyl-($C_1$-$C_{12}$)-alkyl, S—($C_1$-$C_{12}$)-alkyl, S—($C_4$-$C_{14}$)-aryl, halogens, where the alkyl, heteroalkyl, cycloalkyl, heterocycloalkyl, aryl and heteroaryl groups mentioned are optionally mono- or polysubstituted.

In one embodiment, $R^1$, $R^2$, $R^{11}$, $R^{12}$, $R^{13}$, $R^{14}$, $R^{22}$, $R^{23}$, $R^{25}$, $R^{26}$, $R^{33}$, $R^{34}$, $R^{38}$, $R^{39}$, $R^{46}$, $R^{47}$ are selected from: —H, ($C_1$-$C_{12}$)-acyl.

In one embodiment, $R^3$, $R^4$, $R^5$, $R^6$, $R^7$, $R^8$, $R^9$, $R^{10}$, $R^{15}$, $R^{16}$, $R^{17}$, $R^{18}$, $R^{19}$, $R^{20}$, $R^{21}$, $R^{24}$, $R^{27}$, $R^{28}$, $R^{29}$, $R^{30}$, $R^{31}$, $R^{32}$, $R^{35}$, $R^{36}$, $R^{37}$, $R^{40}$, $R^{41}$, $R^{42}$, $R^{43}$, $R^{44}$, $R^{45}$, $R^{48}$ are selected from: hydrogen, hydroxyl, ($C_1$-$C_{12}$)-alkyl, ($C_4$-$C_{14}$)-aryl, O—($C_1$-$C_{12}$)-alkyl, O—($C_1$-$C_{12}$)-heteroalkyl, O—($C_4$-$C_{14}$)-aryl, O—($C_3$-$C_{12}$)-cycloalkyl, S—($C_1$-$C_{12}$)-alkyl, S—($C_4$-$C_{14}$)-aryl, halogens, where the alkyl, heteroalkyl, cycloalkyl and aryl groups mentioned are optionally mono- or polysubstituted.

A process for the electrochemical coupling of anilines is claimed.

Electrochemical process for preparing biaryldiamines, comprising the process steps of:

a) introducing a solvent or solvent mixture and a conductive salt into a reaction vessel, b) adding the anilines, which may be two different anilines or just one aniline, to the reaction vessel, c) introducing two electrodes into the reaction solution, d) applying a voltage to the electrodes, e) coupling the first aniline to itself or to the second aniline to give a biaryldiamine.

Process steps a) to c) can be effected here in any sequence.

The process can be conducted at different carbon electrodes (glassy carbon, boron-doped diamond, graphite, carbon fibres, nanotubes, inter alia), metal oxide electrodes and metal electrodes. Current densities in the range of 1-50 $mA/cm^2$ are applied.

The workup and recovery of the biaryldiamines is very simple and is effected by common standard separation methods after the reaction has ended. First of all, the electrolyte solution is distilled once and the individual compounds are obtained separately in the form of different fractions. A further purification can be effected, for example, by crystallization, distillation, sublimation or chromatography.

The electrolysis is conducted in the customary electrolysis cells known to those skilled in the art. Suitable electrolysis cells are known to those skilled in the art.

The process according to the invention solves the problem mentioned at the outset.

In this way, it is possible to prepare biaryldiamines which form through coupling of the same aniline and/or biaryldiamines which form through the electrochemical coupling of two different anilines.

In this context, anilines are coupled to the same aniline or to anilines with different oxidation potential.

Electrochemical process for preparing biaryldiamines, comprising the process steps of:

a') introducing a solvent or solvent mixture and a conductive salt into a reaction vessel, b') adding a first aniline having an oxidation potential $|E_{Ox}1|$ to the reaction vessel, c') adding a second aniline having an oxidation potential $|E_{Ox}2|$ to the reaction vessel, where: $|E_{Ox}2|>|E_{Ox}1|$ and $|E_{Ox}2|-|E_{Ox}1|=|\Delta E|$, the second aniline being added in excess relative to the first aniline, and the solvent or solvent mixture being selected such that |ΔE| is in the range from 10 mV to 450 mV, d') introducing two electrodes into the reaction solution, e') applying a voltage to the electrodes, f') coupling the first aniline to the second aniline to give a biaryldiamine.

A problem which occurs in the electrochemical coupling of different molecules is that the co-reactants generally have different oxidation potentials $E_{Ox}$. The result of this is that the molecule having the lower oxidation potential has a higher drive to release an electron ($e^-$) to the anode and a $H^+$ ion to the solvent, for example, than the molecule having the higher oxidation potential. The oxidation potential $E_{Ox}$ can be calculated via the Nernst equation:

$$E_{Ox}=E^{\circ}+(0.059/n)*Ig([Ox]/[\mathrm{Red}])$$

$E_{Ox}$: electrode potential for the oxidation reaction (=oxidation potential)

E°: standard electrode potential n: number of electrons transferred

[Ox]: concentration of the oxidized form

[Red]: concentration of the reduced form

If the literature methods cited above were to be applied to two different anilines, the result of this would be to form predominantly radicals of the molecule having a lower oxidation potential, and these would then react with one another. By far the predominant main product obtained would thus be a biaryldiamine which has formed from two identical anilines.

This problem does not occur in the coupling of identical molecules.

If the first condition is not met, the main product formed is the biaryldiamine which forms through the coupling of two molecules of one aniline.

For an efficient reaction regime in the coupling of two different anilines, two reaction conditions are necessary:

- the aniline having the higher oxidation potential has to be added in excess, and
- the difference in the two oxidation potentials (ΔE) has to be within a particular range.

For the process according to the invention, the knowledge of the absolute oxidation potentials of the two anilines is not absolutely necessary. It is sufficient when the difference between the two oxidation potentials is known.

A further aspect of the invention is that the difference in the two oxidation potentials (|ΔE|) can be influenced via the solvents or solvent mixtures used.

For instance, the difference in the two oxidation potentials (|ΔE|) can be shifted into the desired range by suitable selection of the solvent/solvent mixture.

Proceeding from 1,1,1,3,3,3-hexafluoroisopropanol (HFIP) as the base solvent, an excessively small |ΔE| can be increased, for example, by addition of alcohol. An excessively large ΔE, in contrast, can be lowered by addition of water.

With the aid of the process according to the invention, it has been possible for the first time to electrochemically prepare biaryldiamines, and to dispense with multistage syntheses using metallic reagents.

In one variant of the process, the second aniline is used in at least twice the amount relative to the first aniline.

In one variant of the process, the ratio of first aniline to second aniline is in the range from 1:2 to 1:4.

In one variant of the process, the conductive salt is selected from the group of alkali metal, alkaline earth metal, tetra($C_1$-$C_6$-alkyl)ammonium, 1,3-di($C_1$-$C_6$-alkyl)imidazolium or tetra($C_1$-$C_6$-alkyl)phosphonium salts.

In one variant of the process, the counterions of the conductive salts are selected from the group of sulphate, hydrogensulphate, alkylsulphates, arylsulphates, alkylsulphonates, arylsulphonates, halides, phosphates, carbonates, alkylphosphates, alkylcarbonates, nitrate, tetrafluoroborate, hexafluorophosphate, hexafluorosilicate, fluoride and perchlorate.

In one variant of the process, the conductive salt is selected from tetra($C_1$-$C_6$-alkyl)ammonium salts, and the counterion is selected from sulphate, alkylsulphate, arylsulphate.

In one variant of the process, the reaction solution is free of fluorinated compounds.

In one variant of the process, the reaction solution is free of transition metals.

In one variant of the process, the reaction solution is free of organic oxidizing agents.

In one variant of the process, the reaction solution is free of substrates having leaving functionalities other than hydrogen atoms.

In the process claimed, it is possible to dispense with leaving groups at the coupling sites apart from hydrogen atoms.

In one variant of the process, the first aniline and the second aniline are selected from: Ia, Ib, IIa, IIb, IIIa, IIIb, IVa, IVb:

(Ia)

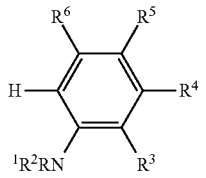

(Ib)

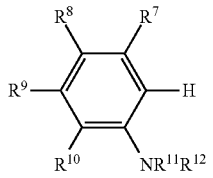

(IIa)

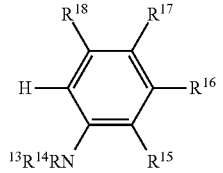

(IIb)

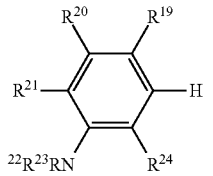

(IIIa)

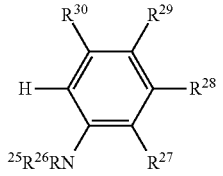

-continued (IIIb)

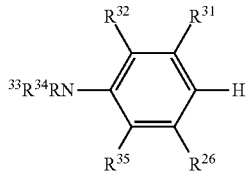

(IVa)

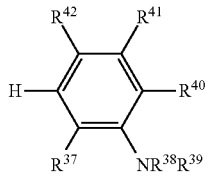

(IVb)

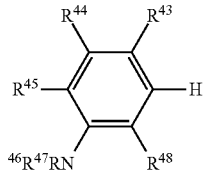

where the substituents $R^1$ to $R^{48}$ are each independently selected from the group of hydrogen, hydroxyl, $(C_1-C_{12})$-alkyl, $(C_1-C_{12})$-heteroalkyl, $(C_4-C_{14})$-aryl, $(C_4-C_{14})$-aryl-$(C_1-C_{12})$-alkyl, $(C_4-C_{14})$-aryl-O—$(C_1-C_{12})$-alkyl, $(C_3-C_{14})$-heteroaryl, $(C_3-C_{14})$-heteroaryl-$(C_1-C_{12})$-alkyl, $(C_3-C_{12})$-cycloalkyl, $(C_3-C_{12})$-cycloalkyl-$(C_1-C_{12})$-alkyl, $(C_3-C_{12})$-heterocycloalkyl, $(C_3-C_{12})$-heterocycloalkyl-$(C_1-C_{12})$-alkyl, O—$(C_1-C_{12})$-alkyl, O—$(C_1-C_{12})$-heteroalkyl, O—$(C_4-C_{14})$-aryl, O—$(C_4-C_{14})$-aryl-$(C_1-C_{14})$-alkyl, O—$(C_3-C_{14})$-heteroaryl, O—$(C_3-C_{14})$-heteroaryl-$(C_1-C_{14})$-alkyl, O—$(C_3-C_{12})$-cycloalkyl, O—$(C_3-C_{12})$-cycloalkyl-$(C_1-C_{12})$-alkyl, O—$(C_3-C_{12})$-heterocycloalkyl, O—$(C_3-C_{12})$-heterocycloalkyl-$(C_1-C_{12})$-alkyl, halogens, S—$(C_1-C_{12})$-alkyl, S—$(C_1-C_{12})$-heteroalkyl, S—$(C_4-C_{14})$-aryl, S—$(C_4-C_{14})$-aryl-$(C_1-C_{14})$-alkyl, S—$(C_3-C_{14})$-heteroaryl, S—$(C_3-C_{14})$-heteroaryl-$(C_1-C_{14})$-alkyl, S—$(C_3-C_{12})$-cycloalkyl, S—$(C_3-C_{12})$-cycloalkyl-$(C_1-C_{12})$-alkyl, S—$(C_3-C_{12})$-heterocycloalkyl, $(C_1-C_{12})$-acyl, $(C_4-C_{14})$-aroyl, $(C_4-C_{14})$-aroyl-$(C_1-C_{14})$-alkyl, $(C_3-C_{14})$-heteroaroyl, $(C_1-C_{14})$-dialkylphosphoryl, $(C_4-C_{14})$-diarylphosphoryl, $(C_3-C_{12})$-alkylsulphonyl, $(C_3-C_{12})$-cycloalkylsulphonyl, $(C_4-C_{12})$-arylsulphonyl, $(C_1-C_{12})$-alkyl-$(C_4-C_{12})$-arylsulphonyl, $(C_3-C_{12})$-heteroarylsulphonyl, (C═O)O—$(C_1-C_{12})$-alkyl, (C═O)O—$(C_1-C_{12})$-heteroalkyl, (C═O)O—$(C_4-C_{14})$-aryl, where the alkyl, heteroalkyl, cycloalkyl, heterocycloalkyl, aryl and heteroaryl groups mentioned are optionally mono- or polysubstituted.

Alkyl represents an unbranched or branched aliphatic radical.

Aryl for aromatic (hydrocarbyl) radicals, preferably having up to 14 carbon atoms, for example phenyl ($C_6H_5$—), naphthyl ($C_{10}H_7$—), anthryl ($C_{14}H_9$—), preferably phenyl.

Cycloalkyl for saturated cyclic hydrocarbons containing exclusively carbon atoms in the ring.

Heteroalkyl for an unbranched or branched aliphatic radical which may contain one to four, preferably one or two, heteroatom(s) selected from the group consisting of N, O, S and substituted N.

Heteroaryl for an aryl radical in which one to four, preferably one or two, carbon atom(s) may be replaced by heteroatoms selected from the group consisting of N, O, S and substituted N, where the heteroaryl radical may also be part of a larger fused ring structure.

Heterocycloalkyl for saturated cyclic hydrocarbons which may contain one to four, preferably one or two, heteroatom(s) selected from the group consisting of N, O, S and substituted N.

A heteroaryl radical which may be part of a fused ring structure is preferably understood to mean systems in which fused five- or six-membered rings are formed, for example benzofuran, isobenzofuran, indole, isoindole, benzothiophene, benzo(c)thiophene, benzimidazole, purine, indazole, benzoxazole, quinoline, isoquinoline, quinoxaline, quinazoline, cinnoline, acridine.

The substituted N mentioned may be monosubstituted, and the alkyl, heteroalkyl, cycloalkyl, heterocycloalkyl, aryl and heteroaryl groups may be mono- or polysubstituted, more preferably mono-, di- or trisubstituted, by radicals selected from the group consisting of hydrogen, $(C_1-C_{14})$-alkyl, $(C_1-C_{14})$-heteroalkyl, $(C_4-C_{14})$-aryl, $(C_4-C_{14})$-aryl-$(C_1-C_{14})$-alkyl, $(C_3-C_{14})$-heteroaryl, $(C_3-C_{14})$-heteroaryl-$(C_1-C_{14})$-alkyl, $(C_3-C_{12})$-cycloalkyl, $(C_3-C_{12})$-cycloalkyl-$(C_1-C_{14})$-alkyl, $(C_3-C_{12})$-heterocycloalkyl, $(C_3-C_{12})$-heterocycloalkyl-$(C_1-C_{14})$-alkyl, $CF_3$, halogen (fluorine, chlorine, bromine, iodine), $(C_1-C_{10})$-haloalkyl, hydroxyl, $(C_1-C_{14})$-alkoxy, $(C_4-C_{14})$-aryloxy, O—$(C_1-C_{14})$-alkyl-$(C_4-C_{14})$-aryl, $(C_3-C_{14})$-heteroaryloxy, $N((C_1-C_{14})\text{-alkyl})_2$, $N((C_4-C_{14})\text{-aryl})_2$, $N((C_1-C_{14})\text{-alkyl})((C_4-C_{14})\text{-aryl})$, where alkyl, aryl, cycloalkyl, heteroalkyl, heteroaryl and heterocycloalkyl are each as defined above.

In one embodiment, $R^1$, $R^2$, $R^{11}$, $R^{12}$, $R^{13}$, $R^{14}$, $R^{22}$, $R^{23}$, $R^{25}$, $R^{26}$, $R^{33}$, $R^{34}$, $R^{38}$, $R^{39}$, $R^{46}$, $R^{47}$ are selected from —H and/or a protecting group for amino functions described in "Greene's Protective Groups in Organic Synthesis" by P. G. M. Wuts and T. W. Greene, 4th edition, Wiley Interscience, 2007, p. 696-926.

In one embodiment, $R^3$, $R^4$, $R^5$, $R^6$, $R^7$, $R^8$, $R^9$, $R^{10}$, $R^{15}$, $R^{16}$, $R^{17}$, $R^{18}$, $R^{19}$, $R^{20}$, $R^{21}$, $R^{24}$, $R^{27}$, $R^{28}$, $R^{29}$, $R^{30}$, $R^{31}$, $R^{32}$, $R^{35}$, $R^{36}$, $R^{37}$, $R^{40}$, $R^{41}$, $R^{42}$, $R^{43}$, $R^{44}$, $R^{45}$, $R^{48}$ are selected from the group of hydrogen, hydroxyl, $(C_1-C_{12})$-alkyl, $(C_1-C_{12})$-heteroalkyl, $(C_4-C_{14})$-aryl, $(C_4-C_{14})$-aryl-$(C_1-C_{12})$-alkyl, O—$(C_1-C_{12})$-alkyl, O—$(C_1-C_{12})$-heteroalkyl, O—$(C_4-C_{14})$-aryl, O—$(C_4-C_{14})$-aryl-$(C_1-C_{14})$-alkyl, O—$(C_3-C_{14})$-heteroaryl, O—$(C_3-C_{14})$-heteroaryl-$(C_1-C_{14})$-alkyl, O—$(C_3-C_{12})$-cycloalkyl, O—$(C_3-C_{12})$-cycloalkyl-$(C_1-C_{12})$-alkyl, O—$(C_3-C_{12})$-heterocycloalkyl, O—$(C_3-C_{12})$-heterocycloalkyl-$(C_1-C_{12})$-alkyl, S—$(C_1-C_{12})$-alkyl, S—$(C_4-C_{14})$-aryl, halogens,
where the alkyl, heteroalkyl, cycloalkyl, heterocycloalkyl, aryl and heteroaryl groups mentioned are optionally mono- or polysubstituted.

In one embodiment, $R^1$, $R^2$, $R^{11}$, $R^{12}$, $R^{13}$, $R^{14}$, $R^{22}$, $R^{23}$, $R^{25}$, $R^{26}$, $R^{33}$, $R^{34}$, $R^{38}$, $R^{39}$, $R^{46}$, $R^{47}$ are selected from: —H, $(C_1-C_{12})$-acyl, In one embodiment, $R^3$, $R^4$, $R^5$, $R^6$, $R^7$, $R^8$, $R^9$, $R^{10}$, $R^{15}$, $R^{16}$, $R^{17}$, $R^{18}$, $R^{19}$, $R^{20}$, $R^{21}$, $R^{24}$, $R^{27}$, $R^{28}$, $R^{29}$, $R^{30}$, $R^{31}$, $R^{32}$, $R^{35}$, $R^{36}$, $R^{37}$, $R^{40}$, $R^{41}$, $R^{42}$, $R^{43}$, $R^{44}$, $R^{45}$, $R^{48}$ are selected from the group of hydrogen, hydroxyl, $(C_1-C_{12})$-alkyl, $(C_4-C_{14})$-aryl, O—$(C_1-C_{12})$-alkyl, O—$(C_1-C_{12})$-heteroalkyl, O—$(C_4-C_{14})$-aryl, O—$(C_3-C_{12})$-cycloalkyl, S—$(C_1-C_{12})$-alkyl, S—$(C_4-C_{14})$-aryl, halogens,
where the alkyl, heteroalkyl, cycloalkyl and aryl groups mentioned are optionally mono- or polysubstituted.

In this context, the following combinations are possible:

| | | | | | | | | |
|---|---|---|---|---|---|---|---|---|
| first aniline | | | | Ia | | | IIb | |
| second aniline | | | | Ia | | | IIb | |
| first aniline | Ia | Ib | IIa | IIb | IIIa | IIIb | IVa | IVb |
| second aniline | Ib | Ia | IIb | IIa | IIIb | IIIa | IVb | IVa |

The invention is illustrated in detail hereinafter by FIGS. 1 and 2.

FIG. 1 shows a reaction apparatus in which the above-described coupling reaction can be conducted. The apparatus comprises a nickel cathode (1) and an anode of boron-doped diamond (BDD) on silicon or another support material, or another electrode material (5) known to those skilled in the art. The apparatus can be cooled with the aid of the cooling jacket (3). The arrows here indicate the flow direction of the cooling water. The reaction chamber is sealed with a Teflon stopper (2). The reaction mixture is mixed by a magnetic stirrer bar (7). On the anodic side, the apparatus is sealed by means of screw clamps (4) and seals (6).

Figure 2:
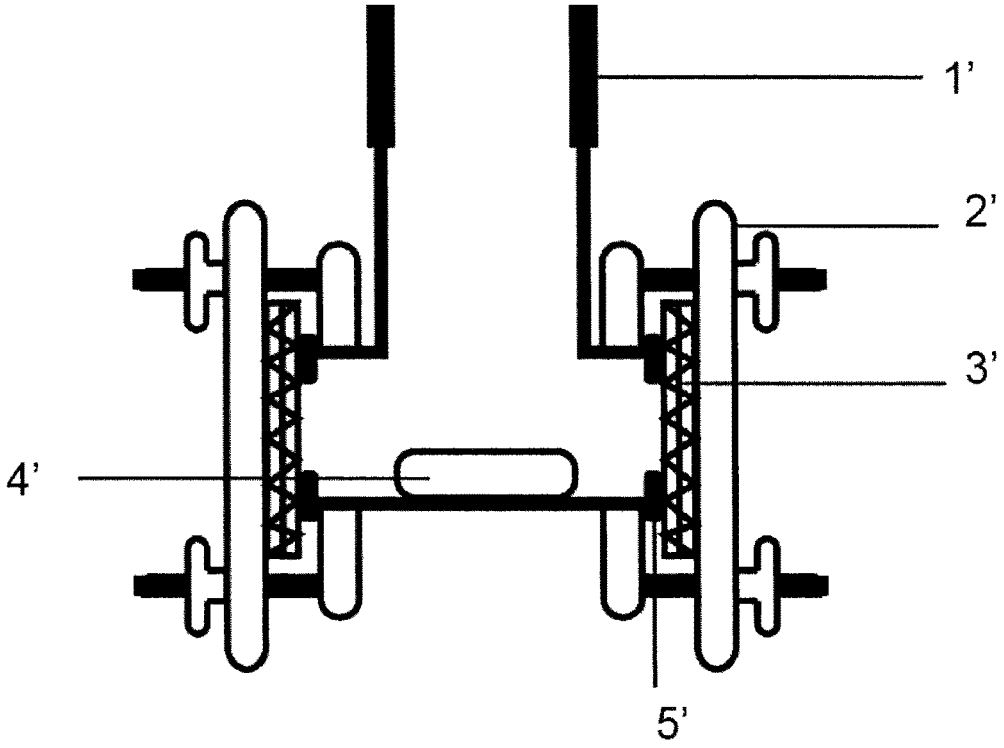
FIG. 2 shows a reaction apparatus for performing a coupling reaction according to one or more embodiments of the invention, on a larger scale than that depicted in FIG. 1.

FIG. 2 shows a reaction apparatus in which the above-described coupling reaction can be conducted on a larger scale. The apparatus comprises two glass flanges (5'), through which, by means of screw clamps (2') and seals, electrodes (3') of boron-doped diamond (BDD)-coated support materials or other electrode materials known to those skilled in the art are pressed on. The reaction chamber can be provided with a reflux condenser via a glass sleeve (1'). The reaction mixture is mixed with the aid of a magnetic stirrer bar (4').

EXAMPLES

General Procedures

Cyclic Voltammetry (CV)

A Metrohm 663 VA stand equipped with a μAutolab type III potentiostat was used (Metrohm A G, Herisau, Switzerland). WE: glassy carbon electrode, diameter 2 mm; AE: glassy carbon rod; RE: Ag/AgCl in saturated LiCl/EtOH. Solvent: HFIP+0-25% v/v MeOH. Oxidation criterion: j=0.1 mA/cm$^2$, v=50 mV/s, T=20° C. Mixing during the measurement. c(aniline derivative)=151 mM, conductive salt: $Et_3NMe$ $O_3SOMe$ (MTES), c(MTES)=0.09M.

Chromatography

The preparative liquid chromatography separations via flash chromatography were conducted with a maximum pressure of 1.6 bar on 60 M silica gel (0.040-0.063 mm) from Macherey-Nagel GmbH & Co, Düren. The unpressurized separations were conducted on Geduran Si 60 silica gel (0.063-0.200 mm) from Merck KGaA, Darmstadt. The solvents used as eluents (ethyl acetate (technical grade), cyclohexane (technical grade)) had been purified beforehand by distillation on a rotary evaporator.

For thin-layer chromatography (TLC), ready-made PSC silica gel 60 F254 plates from Merck KGaA, Darmstadt were used. The Rf values are reported as a function of the eluent mixture used. Staining of the TLC plates was effected using a cerium-molybdatophosphoric acid solution as a dipping reagent. Cerium-molybdatophosphoric acid reagent: 5.6 g of molybdatophosphoric acid, 2.2 g of cerium(IV) sulphate tetrahydrate and 13.3 g of concentrated sulphuric acid to 200 milliliters of water.

Gas Chromatography (GC/GCMS)

The gas chromatography analyses (GC) of product mixtures and pure substances were effected with the aid of the GC-2010 gas chromatograph from Shimadzu, Japan. Measurement is effected on an HP-5 quartz capillary column from Agilent Technologies, USA (length: 30 m; internal diameter: 0.25 mm; film thickness of the covalently bound stationary phase: 0.25 μm; carrier gas: hydrogen; injector temperature: 250° C.; detector temperature: 310° C.; programme: "hard" method: start temperature 50° C. for 1 min, heating rate: 15° C./min, final temperature 290° C. for 8 min). Gas chromatography mass spectra (GCMS) of product mixtures and pure substances were recorded with the aid of the GC-2010 gas chromatograph combined with the GCMS-QP2010 mass detector from Shimadzu, Japan. Measurement is effected on an HP-1 quartz capillary column from Agilent Technologies, USA (length: 30 m; internal diameter: 0.25 mm; film thickness of the covalently bound stationary phase: 0.25 μm; carrier gas: hydrogen; injector temperature: 250° C.; detector temperature: 310° C.; programme: "hard" method: start temperature 50° C. for 1 min, heating rate: 15° C./min, final temperature 290° C. for 8 min; GCMS: ion source temperature: 200° C.).

Melting Points

Melting points were measured with the aid of the SG 2000 melting point measuring instrument from HW5, Mainz and are uncorrected.

Elemental Analysis

The elemental analyses were conducted in the Analytical Division of the Department of Organic Chemistry at the Johannes Gutenberg University of Mainz on a Vario EL Cube from Foss-Heraeus, Hanau.

Mass Spectrometry

All electrospray ionization analyses (ESI+) were conducted on a QT of Ultima 3 from Waters Micromasses, Milford, Mass. EI mass spectra and the high-resolution EI spectra were measured on an instrument of the MAT 95 XL sector-field instrument type from Thermo Finnigan, Bremen.

NMR Spectroscopy

The NMR spectroscopy studies were conducted on multinuclear resonance spectrometers of the AC 300 or AV II 400 type from Bruker, Analytische Messtechnik, Karlsruhe. The solvent used was $CDCl_3$. The $^1H$ and $^{13}C$ spectra were calibrated according to the residual content of undeuterated solvent according to the NMR Solvent Data Chart from Cambridge Isotopes Laboratories, USA. Some of the $^1H$ and $^{13}C$ signals were assigned with the aid of H,H COSY, H,H NOESY, H,C HSQC and H,C HMBC spectra. The chemical shifts are reported as δ values in ppm. For the multiplicities of the NMR signals, the following abbreviations were used: s (singlet), bs (broad singlet), d (doublet), t (triplet), q (quartet), m (multiplet), dd (doublet of doublets), dt (doublet of triplets), tq (triplet of quartets). All coupling constants J were reported with the number of bonds covered in Hertz (Hz). The numbers reported in the signal assignment correspond to the numbering given in the formula schemes, which need not correspond to IUPAC nomenclature.

GM1: General Method for Electrochemical Cross-Coupling 2-4 mmol of the respective deficiency component are dissolved together with 6-12 mmol of the respective second component to be coupled in the amounts of 1,1,1,3,3,3-hexafluoroisopropanol (HFIP) and MeOH specified and converted in an undivided beaker cell with glassy carbon electrodes. The electrolysis is effected under galvanostatic conditions. The reaction is stirred and heated to 50° C. with the aid of a water bath. After the end of the electrolysis, the cell contents are transferred together with HFIP into a 50 ml round-bottom flask and the solvent is removed under reduced pressure on a rotary evaporator at 50° C., 200-70 mbar. Unconverted reactant is retained by means of short-path distillation or Kugelrohr distillation (100° C., $10^{-3}$ mbar).

Electrode Material

Anode: glassy carbon

Cathode: glassy carbon

Electrolysis Conditions:

Temperature [T]: 50° C.

Current [I]: 25 mA

Current density [j]: 2.8 mA/cm$^2$

Quantity of charge [Q]: 2 F (per deficiency component)

Terminal voltage [$U_{max}$]: 3-5 V

N-(6-(2-Acetamido-4-methoxy-5-methylphenyl)3,4-methylenedioxyphenyl)acetamide

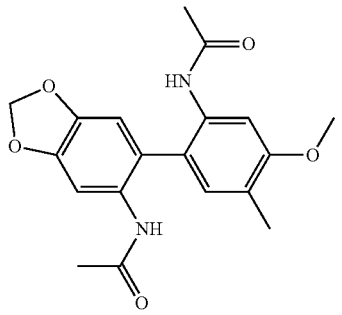

The electrolysis is performed according to GM1 in an undivided beaker cell having glassy carbon electrodes. For this purpose, 0.68 g (3.8 mmol, 1.0 equiv.) of N-(3,4-methylene-dioxyphenyl)acetamide and 2.04 g (11.4 mmol, 3.0 equiv.) of N-(3,4-dimethoxy-phenyl)acetamide are dissolved in 25 ml of HFIP, 0.77 g of MTBS is added and the electrolyte is transferred into the electrolysis cell. After the electrolysis, the solvent and unconverted volumes of reactant are removed under reduced pressure, the crude product is purified on silica gel 60 in the form of a "flash chromatography" in 1:3 eluent (CH:EE)+1% acetic acid, and the product is obtained as an ochre-brown solid.

Yield: 718 mg (55%, 2.1 mmol)

Selectivity: 15:1 (cross-coupling:homo-coupling)

GC (hard method, HP-5): $t_R$=17.37 min $R_f$(CH:EE=1:3)=0.21

$^1$H NMR (300 MHz, CDCl3) δ=1.94 (s, 3H), 1.98 (s, 3H), 2.18 (s, 3H), 3.86 (s, 3H), 5.95-6.07 (m, 2H), 6.62 (s, 1H), 6.89 (bs, 1H), 7.02 (bs, 1H), 7.48 (m, 2H), 7.70 (s, 1H);

$^{13}$C NMR (75 MHz, CCl3) δ=15.79, 23.84, 24.19, 55.50, 101.67, 104.89, 105.42, 110.01, 119.90, 122.70, 123.59, 129.47, 132.04, 134.26, 145.22, 147.76, 157.88, 169.36, 169.44. HRMS for $C_{19}H_{20}N_2O_5$(ESI+) [M+Na$^+$]: calc.: 379.1270. found: 379.1265.

MS (EI, GCMS): m/z (%): 356 (80) [M]$^+$, 297 (80) [M-$CH_3CONH_2$]$^+$.

The invention claimed is:

1. Electrochemical process for preparing biaryldiamines, comprising the process steps of:

a') introducing a solvent or solvent mixture and a conductive salt into a reaction vessel, b') adding a first aniline having an oxidation potential $|E_{Ox}1|$ to the reaction vessel, c') adding a second aniline having an oxidation potential $|E_{OX}2|$ to the reaction vessel, to obtain a reaction solution, where: $|E_{Ox}2|>|E_{Ox}1|$ and $|E_{Ox}2|-|E_{Ox}1|=|\Delta E|$, the second aniline being added in excess relative to the first aniline, and the solvent or solvent mixture being selected such that $|\Delta E|$ is in the range from 10 mV to 450 mV, d') introducing two electrodes into the reaction solution, e') applying a voltage to the electrodes, and f') coupling the first aniline to the second aniline to give a biaryldiamine, wherein the first aniline and the second aniline each has a formula independently selected from the group consisting of Ia, Ib, IIa, IIb, IIIa, IIIb, IVa, and IVb:

(Ia)

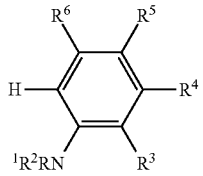

(Ib)

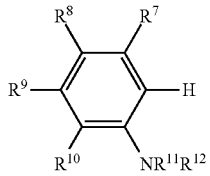

(IIa)

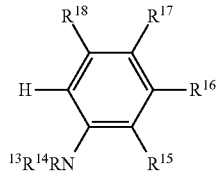

(IIb)

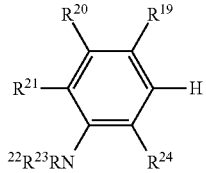

(IIIa)

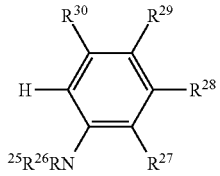

(IIIb)

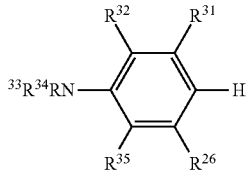

(IVa)

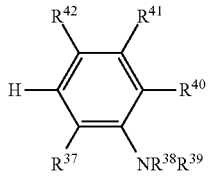

(IVb)

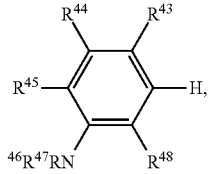

where the substituents $R^1$ to $R^{48}$ are each independently selected from the group consisting of hydrogen, ($C_1$-$C_{12}$)-alkyl, ($C_1$-$C_{12}$)-heteroalkyl, ($C_4$-$C_{14}$)-aryl, ($C_4$-$C_{14}$)-aryl-($C_1$-$C_{12}$)-alkyl, ($C_4$-$C_{14}$)-aryl-O—($C_1$-$C_{12}$)-alkyl, ($C_3$-$C_{14}$)-heteroaryl, ($C_3$-$C_{14}$)-heteroaryl-($C_1$-$C_{12}$)-alkyl, ($C_3$-$C_{12}$)-cycloalkyl, ($C_3$-$C_{12}$)-cycloalkyl- $(C_1-C_{12})$-alkyl, $(C_3-C_{12})$-heterocycloalkyl, $(C_3-C_{12})$-heterocycloalkyl-$(C_1-C_{12})$-alkyl, O—$(C_1-C_{12})$-alkyl, O—$(C_1-C_{12})$-heteroalkyl, O—$(C_4-C_{14})$-aryl, O—$(C_4-C_{14})$-aryl-$(C_1-C_{14})$-alkyl, O—$(C_3-C_{14})$-heteroaryl, O—$(C_3-C_{14})$-heteroaryl-$(C_1-C_{14})$-alkyl, O—$(C_3-C_{12})$-cycloalkyl, O—$(C_3-C_{12})$-cycloalkyl-$(C_1-C_{12})$-alkyl, O—$(C_3-C_{12})$-heterocycloalkyl, O—$(C_3-C_{12})$-heterocycloalkyl-$(C_1-C_{12})$-alkyl, halogens, S—$(C_1-C_{12})$-alkyl, S—$(C_1-C_{12})$-heteroalkyl, S—$(C_4-C_{14})$-aryl, S—$(C_4-C_{14})$-aryl-$(C_1-C_{14})$-alkyl, S—$(C_3-C_{14})$-heteroaryl, S—$(C_3-C_{14})$-heteroaryl-$(C_1-C_{14})$-alkyl, S—$(C_3-C_{12})$-cycloalkyl, S—$(C_3-C_{14})$-cycloalkyl-$(C_1-C_{12})$-alkyl, S—$(C_3-C_{12})$-heterocycloalkyl, $(C_1-C_{12})$-acyl, $(C_4-C_{14})$-aroyl, $(C_4-C_{14})$-aroyl, $(C_4-C_{14})$-aroyl-$(C_1-C_{14})$-alkyl, $(C_3-C_{14})$-heteroaroyl, $(C_1-C_{14})$-dialkylphosphoryl, $(C_4-C_{14})$-diarylphosphoryl, $(C_3-C_{12})$-alkylsulphonyl, $(C_3-C_{12})$-cycloalkylsulphonyl, $(C_4-C_{12})$-arylsulphonyl, $(C_1-C_{12})$-alkyl-$(C_4-C_{12})$-arylsulphonyl, $(C_3-C_{12})$-heteroarylsulphonyl, (C═O)O—$(C_1-C_{12})$-alkyl, (C═O)O—$(C_1-C_{12})$-heteroalkyl, and (C═O)O—$(C_4-C_{14})$-aryl, where the alkyl, heteroalkyl, cycloalkyl, heterocycloalkyl, awl and heteroaryl groups are optionally mono- or polysubstituted.

2. Process according to claim 1, wherein the second aniline is used in at least twice the amount relative to the first aniline.

3. Process according to claim 1, wherein the ratio of first aniline to second aniline is in the range from 1:2 to 1:4.

4. Process according to claim 1, wherein the solvent or solvent mixture is selected such that OE is in the range from 20 mV to 400 mV.

5. Process according to claim 1, wherein the reaction solution is free of organic oxidizing agents.

* * * * *